US005209408A

United States Patent [19]

Reiter

[11] Patent Number: 5,209,408

[45] Date of Patent: May 11, 1993

[54] ELECTROMAGNETICALLY OPERATED FUEL INJECTION VALVE

[75] Inventor: Ferdinand Reiter, Markgröningen, Fed. Rep. of Germany

[73] Assignee: Robert Bosch GmbH, Stuttgart, Fed. Rep. of Germany

[21] Appl. No.: 852,171

[22] PCT Filed: Sep. 13, 1992

[86] PCT No.: PCT/DE90/00702
§ 371 Date: Apr. 2, 1992
§ 102(e) Date: Apr. 2, 1992

[87] PCT Pub. No.: WO91/05951
PCT Pub. Date: May 2, 1991

[30] Foreign Application Priority Data

Oct. 21, 1989 [DE] Fed. Rep. of Germany ..... 3935148

[51] Int. Cl.[5] ..... B05B 1/30

[52] U.S. Cl. ..... 239/585.4; 239/585.1; 251/129.21; 251/129.15

[58] Field of Search ..... 239/583, 584, 585.1, 239/585.2, 585.4; 251/129.15, 129.14, 129.21; 137/901

[56] References Cited

U.S. PATENT DOCUMENTS 4,264,040 4/1981 Saito ..... 439/585.1
4,286,623 9/1981 Leiber ..... 251/129.15
4,423,841 1/1984 Palma ..... 239/585.4
4,477,027 10/1984 Knapp et al. ..... 251/129.21
4,597,558 7/1986 Hafner et al. ..... 251/129.15
4,984,744 1/1991 Babitzka et al. ..... 239/585.4
4,995,559 2/1991 Okamoto et al. ..... 239/585.4

FOREIGN PATENT DOCUMENTS 0042799 12/1981 European Pat. Off. .
2807052 8/1987 Fed. Rep. of Germany .

*Primary Examiner*—Andres Kashnikow
*Assistant Examiner*—Christopher G. Trainor
*Attorney, Agent, or Firm*—Michael J. Striker

[57] ABSTRACT

In order to provide a highly accurate alignment of the outlet opening (14), the valve seat (13) and the guideway (22) in the fuel injection valve, a separate guide ring (21) delimiting the axial guideway (22) for the valve closing body (17) rests on a collar step (12) with a radial separation from the wall (10) of the longitudinal hole (11) of the valve seat body (5). The guide ring is spring loaded against the collar step to be held in position around the valve seat by holding forces which are greater than the forces acting on the guide ring during operation of the fuel injection valve.

5 Claims, 1 Drawing Sheet

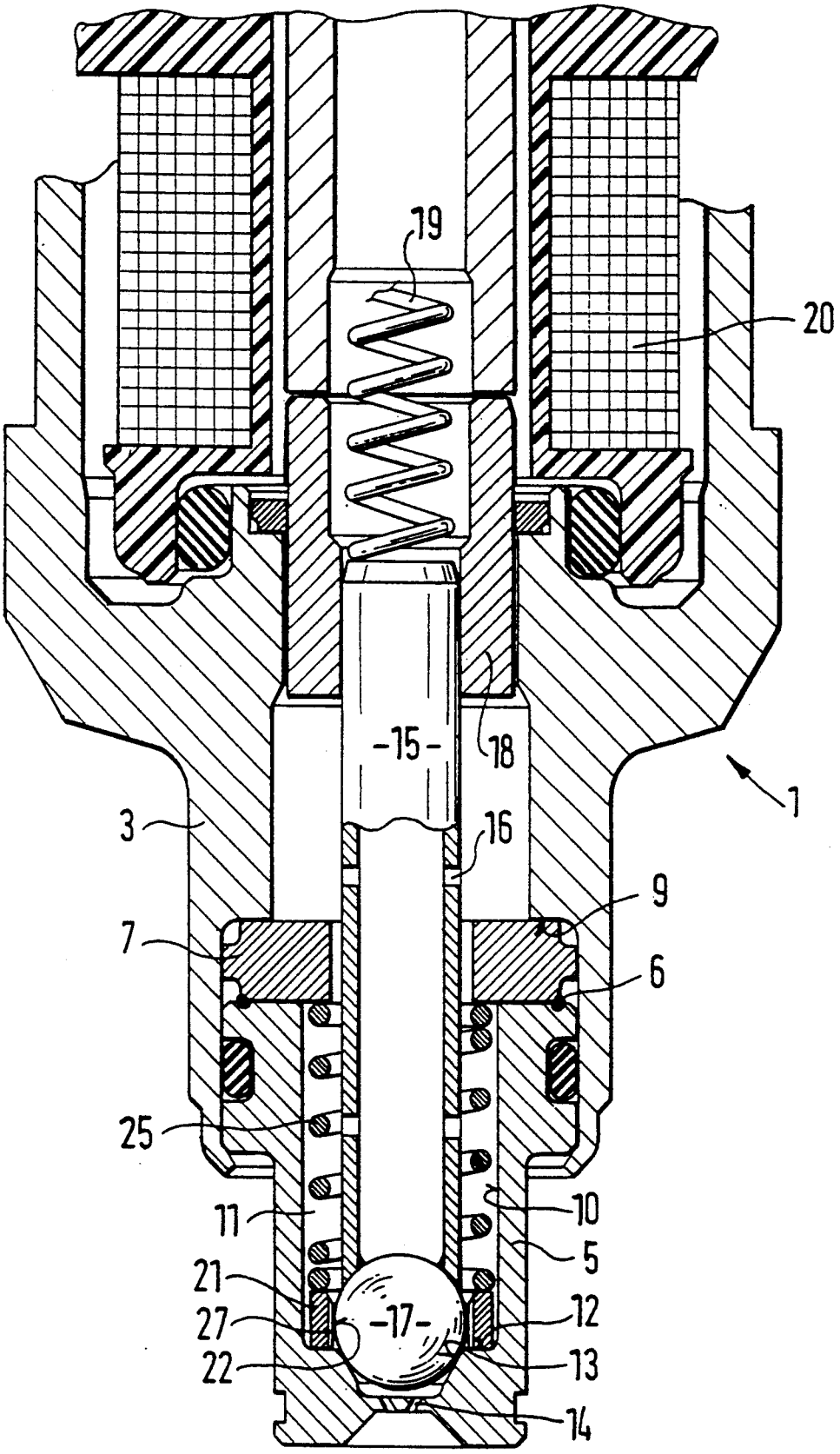
19
20
-15-
18
1
3
16
9
7
6
25
11
10
5
21
27
-17-
12
22
13
14

ELECTROMAGNETICALLY OPERATED FUEL INJECTION VALVE

BACKGROUND OF THE INVENTION

The invention is based on a fuel injection valve of the generic type which includes a valve housing, a valve seat body arranged in the valve housing and having an axially directed longitudinal hole terminating at a collar step which narrows into a valve seat with an outlet opening; a valve closing member is inserted in the longitudinal hole and is provided at its end facing the valve seat with a valve closing body which is guided in a hollow cylindrical guideway.

A fuel injection valve of the generic type is known from the DE-PS 31 02 642 and the U.S. Pat. No. 4,403,741. In such a valve, a part described as a nozzle, and a separate perforated disc have been combined to form an assembly. The perforated disc with valve seat and with a hollow cylindrical guideway, guides the valve closing body during its axial movement. The nozzle is provided with an outlet opening for the fuel to be injected, and it locates the perforated disc in a press fit.

Other fuel injection valves are known, in which the nozzle and the valve seat are designed to form a one-piece valve seat body—without a hollow cylindrical guideway.

The manufacturing costs for the perforated disc are high due to the requirements for high accuracy with regard to the concentricity of the hollow cylindrical guideway to the valve seat. Moreover, the nozzle requires very precise machining in the area for the location of the perforated disc. This makes the individual parts and their assembly more expensive. Minor deviations from the size tolerances of these individual parts will cause a deformation of the valve seat during the assembly of the fuel injection valve. Such quality defects cause a higher friction between the valve closing member, the guideways, and the valve seat.

This friction leads to hysteresis errors during the control of the fuel injection valve, to wear, and also to an increasingly irregular pattern of fuel dispersal. This means that the fuel is less well processed, and the individual engine cylinders are unevenly supplied with fuel. Currently, the fit between the valve closing body and the guideways, which is of coarser tolerances, any eccentric seating of the valve closing body on the valve seat or on the guideway while the fuel injection valve is open, will cause trouble, resulting in the consequences previously mentioned.

SUMMARY OF THE INVENTION

In the fuel injection valve in accordance with the invention the hollow cylindrical guideway is formed in a separate guide ring which is spaced at a radial distance from the wall of the longitudinal hole in the valve seat body; the guide ring is held in a position around the valve seat by tensional holding forces which are greater than external forces exerted thereon by the valve seat body during normal operation of the fuel injection valve. In contrast to prior art fuel injection valves of this type, the invention has the advantage that the hollow cylindrical guideway of a separate guide ring will guide the valve closing body such that it embraces it particularly closely and concentrically, so that this position is secured when the valve closing body is opening and flooded with fuel.

A closer fit between the valve closing body and the hollow cylindrical guideway within closer tolerances is possible with the economic, separate guide ring as the position of the guide ring is always individually adjustable in relation to the valve seat. This means that the friction between the valve closing body and the valve seat is very safely reduced, because the eccentricity of the valve closing body in relation to the valve seat is reduced by virtue of the close guidance. This means that a more precise response of the fuel injection valve is achieved, with a more precise metering of the fuel and an improved pattern of fuel dispersal. The position of the guide ring in relation to the valve seat cannot be influenced by temperature fluctuations due to the radial separation of the aperture which surrounds it. Other advantageous refinements of the invention result from the subordinate claims.

BRIEF DESCRIPTION OF THE DRAWING

An embodiment example of the invention is described in more detail in the description below and by means of the associated drawing. The single FIGURE shows the sectional representation of the valve according to the invention seat area of a fuel injection valve.

DESCRIPTION OF THE PREFERRED EMBODIMENT OF THE INVENTION

Referring to the drawing, the fuel injection valve 1 for a fuel injection system of compressed mixture, spark ignition internal combustion engines, has a valve housing 3, which accepts a valve seat body 5. The valve seat body 5 is linked with a distance ring 7 by a welded connection 6. The distance ring 7 sits with its free front face on a collar area 9 of the valve housing 3 and determines thereby the axial position of the valve seat dody 5 in relation to the valve housing 3. A wall 10 of a central longitudinal hole 11 in the valve seat body 5 forms on that side which faces away from the distance ring 7, a collar step 12, where it narrow to form a valve seat 13, and it ends in an outlet opening 14 which forms the actual injection nozzle.

A pipe-like valve closing member 15 with radial apertures 16 projects into the longitudinal hole 11. On the end side facing the valve seat 13, the valve closing member 15 carries a valve closing body 17 in the shape of a hardened ball. On the end side facing away from the valve seat 13, the valve closing member 15 carries an armature 18 of soft magnetic material.

A compression spring 19 installed in the region of the armature 18 loads the valve closing member 15 in the closing direction. A magnet coil 20 is arranged adjacent to the armature 18 such that, as soon as it is energized, it lifts the armature 18 in opposition to the closing direction of the valve closing member 15.

Located on the collar step 12 is a separate guide ring 21, the hollow cylindrical guideway 22 of which concentrically and closely encloses the valve closing body 17. By a compression spring 25 which is supported on the distance ring 7, the guide ring 21 is loaded normally against the collar step 12 and thereby secured in its position. The guide ring 21 is provided with spiral flutes 27 on its hollow cylindrical guideway 22.

The diameter of the longitudinal hole 11 is substantially larger than the outer diameter of the guide ring 21. Between the wall 10 and the guide ring 21, there is therefore a radial separation. Due to the radial separation between the outer circumference of the guide ring 21 and the longitudinal hole 11, there is a possibility of a sliding or floating displacement in radial direction of the guide ring 21 on the collar step 12. A floating displacement of the guide ring 21 is possible when external forces acting against the guideway 22 overcome the frictional forces between the spring loaded guide ring 21 and the collar step 12. Such external forces must be exerted, for instance, during adjustment of the guide ring 21, by means of a special centering ball or by means of a centering mandrel which is inserted through the hollow cylindrical guideway 22 and which locates the guide ring centrally in relation to the valve seat 13. When the guide ring 21, which is loaded by the compression spring 25, is adjusted inside the valve seat body 5 which has been already welded to the distance ring 7, then the external forces required for the adjustment must be greater than those which act on the guide ring 21 during normal operation of the fuel injection valve. When the guide ring 21 is adjusted inside the valve seat body 5 without the distance ring 7 welded to it, the compression spring 25 may be tensioned to a lesser extent and may load the guide ring 21 with reduced force. The adjustment forces required are then smaller than with the assembly method described above. Here, the valve seat body 5 is to be inserted jointly with the compression spring 25 and the guide ring 21 into the valve housing 3, and to be welded to the distance ring 7.

In order to open the fuel injection valve 1, an electric circuit of the magnet coil 20, not shown, is closed. The magnetic forces which then take effect, pull in the armature 18. Together with this armature, the valve closing body 17 of the valve closing member 15 is moved off the valve seat 13, against the loading compression spring 19, so that the fuel can pass through the valve closing member 15 and its radial openings 16, via the longitudinal hole 11, to the valve seat 13, and downstream to at least one of that seat's outlet openings 14, and can be ejected.

During installation of the valve seat body 5 into the valve housing 3, the valve seat body 5 must be aligned axially with the already mounted valve closing member 15. This position, which takes the envisaged stroke into account, is secured by the welded distance ring 7.

The spiral flutes 27 permit not only a fuel flow past the valve closing body 17, but they also generate a turbulence in the injected fuel and improve the fuel dispersal pattern.

The guide ring 21 can be particularly economically manufactured as a sheet steel stamping.

I claim:

1. Electromagnetically operated fuel injection valve having a valve housing, a valve seat body arranged in the valve housing a longitudinal hole formed in said valve seat body, the wall of said hole having an end portion which narrows into a valve seat with an outlet opening, a valve closing member extending in said hole and being axially movable between a closing position and an opening position, said valve closing member carrying a valve closing body which, in said closing position, rests on said valve seat and, in said opening position, is spaced a definite distance from said valve seat, comprising a separate guide ring positioned on said end portion around said valve seat, the outer diameter of said guide ring being smaller than the diameter of said hole to allow displacement of said guide ring in radial direction, the inner wall of said guide ring forming a cylindrical guideway for guiding said valve closing body into said closing position; and means for tensioning said guide ring against said end portion with holding forces which are greater than the forces exerted on the guide ring during operation of the fuel injection valve.

2. Fuel injection valve in accordance with claim 1, characterized by the fact that the guide ring (21) is manufactured from sheet steel.

3. Fuel injection valve in accordance with claim 1, characterized by the fact that the guide ring (21) is provided with spiral flutes (27) which are open towards the guideway (22).

4. Fuel injection valve in accordance with claim 1, wherein said tensioning means is a compression spring arranged in said hole.

5. Fuel injection valve in accordance with claim 4, wherein said end portion of the wall of the hole is in the form of a collar step; and said compression spring generates frictional holding forces between said guide ring and said collar step which are greater than the forces exerted by said valve closing body against said cylindrical guideway during operation of the fuel injection valve.

* * * * *